US005370557A

United States Patent [19]

Olsson

[11] Patent Number: 5,370,557

[45] Date of Patent: Dec. 6, 1994

[54] KEYING SYSTEM FOR LOW PROFILE CONNECTOR

[75] Inventor: Billy E. Olsson, New Cumberland, Pa.

[73] Assignee: The Whitaker Corporation, Wilmington, Del.

[21] Appl. No.: 142,639

[22] Filed: Oct. 22, 1993

[51] Int. Cl.[5] ..... H01R 13/64

[52] U.S. Cl. ..... 439/681; 439/680

[58] Field of Search ..... 439/677, 678, 679, 680, 439/681, 354, 372

[56] References Cited

U.S. PATENT DOCUMENTS

| | | | |
|---|---|---|---|
| 2,902,665 | 9/1959 | D'Amico | 339/184 |
| 3,177,461 | 4/1965 | Hagen et al. | 339/184 |
| 3,555,491 | 1/1971 | Moss | 339/92 |
| 3,582,867 | 6/1971 | Thompson et al. | 439/677 |
| 3,611,272 | 10/1971 | Sedney et al. | 439/681 |
| 4,109,987 | 8/1978 | Bourdon | 339/75 M |
| 4,376,565 | 3/1983 | Bird et al. | 339/186 M |
| 4,519,667 | 5/1985 | Canning et al. | 339/186 M |
| 4,568,134 | 2/1986 | DiMondi | 339/17 LC |
| 4,580,868 | 4/1986 | Verstijnen | 339/186 M |
| 4,726,791 | 2/1988 | Rudy, Jr. et al. | 439/677 |
| 4,764,129 | 8/1988 | Jones et al. | 439/677 |
| 4,778,411 | 10/1988 | Rudy, Jr. et al. | 439/681 |
| 4,781,626 | 11/1988 | Lazarchik | 439/680 |
| 4,832,625 | 5/1989 | Puerner | 439/681 |
| 4,895,535 | 1/1990 | Emadi et al. | 439/681 |
| 4,925,400 | 5/1990 | Blair et al. | 439/374 |
| 4,929,184 | 5/1990 | Emadi et al. | 439/681 |
| 4,934,950 | 6/1990 | Green et al. | 439/681 |
| 4,952,175 | 8/1990 | Waters et al. | 439/681 |
| 4,986,769 | 1/1991 | Adams, III et al. | 439/681 |
| 4,990,099 | 2/1991 | Marin et al. | 439/284 |
| 5,044,994 | 9/1991 | Van Woensel | 439/681 |
| 5,066,250 | 11/1991 | Welsh | 439/681 |
| 5,147,225 | 9/1992 | Kile et al. | 439/680 |
| 5,199,885 | 4/1993 | Korsunsky et al. | 439/79 |
| 5,219,301 | 6/1993 | Frantz | 439/362 |

*Primary Examiner*—Neil Abrams
*Assistant Examiner*—Hien D. Vu
*Attorney, Agent, or Firm*—Anton P. Ness

[57] ABSTRACT

A keying arrangement for electrical connectors is disclosed for preventing the inadvertent mating of a plug to the wrong receptacle. The opposing ends of the mating plug (14) and receptacle (12) have polygonal openings (80,94) formed completely through their housings that contain opposing polygonal-shaped keys (100) that are axially aligned. Each of the keys is retained in its respective polygonal opening by a pair of wing-like flanges (116) extending from the key that overlies a first surface (86) formed in the housing adjacent the polygonal opening and a locking tab (122) projecting from the key that underlies another surface (92) spaced from the first surface (86).

18 Claims, 7 Drawing Sheets

KEYING SYSTEM FOR LOW PROFILE CONNECTOR

FIELD OF THE INVENTION

The present invention is related to a keying system for low profile, high density electrical connectors that prevents inadvertent mating of connector halves that are not intended to be mated.

BACKGROUND OF THE INVENTION

In electrical equipment having multiple modules or units that are interconnected, it is desirable to provide a keying system that uniquely defines plug and receptacle pairs that are to be mated. There are many such systems in use in the industry. Such systems, however, are typically molded into the connector housings and require considerable space. For example, U.S. Pat. No. 4,778,411 discloses mating electrical connector housings having hexagonal nests formed therein containing hexagonal shaped keys that are positionable in any of six unique angular positions. Each housing has a key that is in axial alignment with a corresponding key in the other housing. Mating of the two housings is prevented unless the two keys are in mutually complimentary angular positions. The shanks of the keys include an undercut that mates with an inwardly facing bead on the interior of the nest and a split end to provide a snap action when the keys are pressed into their seats. The mating ends of the keys are quite long and have tapered ends for lead in and guiding as the connector halves are mated. The large physical size of these keys, resulting from the long tapered ends and the retaining structure, makes this arrangement unsuitable for use with low profile, high density connectors where the available vertical space is limited.

What is needed is a connector keying arrangement that effectively prevents inadvertent mating of the contacts of a plug with the contacts of a receptacle in a low profile connector. Additionally, the keying arrangement should not require that the connector be made larger to accommodate the keys or to require additional space on the circuit board.

SUMMARY OF THE INVENTION

An electrical connector is disclosed having a mating plug and receptacle. Each plug and receptacle includes a housing having electrical contacts therein wherein each contact of the plug mates with a corresponding contact of the receptacle. A first keying arrangement is provided for polarizing to assure proper orientation of the plug with the receptacle during mating thereof.

A second keying arrangement is provided for inhibiting the mating except for mating a plug to a designated receptacle. The second keying arrangement includes a polygonal opening formed through the plug housing and a corresponding polygonal opening formed through the receptacle housing so that when the housings are in mated engagement the polygonal opening in the plug housing is in axial alignment with the corresponding polygonal opening in the receptacle housing. Two keys are included having polygonal shaped outer surfaces that are sized to slip fit into the polygonal openings in each of a plurality of unique angular positions. Each key is in a respective one of the polygonal openings and has an off-set portion extending into the corresponding aligned polygonal opening. A retainer means is provided for holding each key in its respective polygonal opening. Each key is arranged in one of the plurality of angular positions so that the plug and receptacle housings will mate only when the off-set portions of the axially aligned keys are in mating alignment.

In the present invention, each retainer means including a first surface and an opposite second surface spaced axially from the first surface along each side wall of a respective polygonal opening, and further includes at least one flange projecting from a respective key and arranged to overlie the first surface and a locking tab projecting from each key and arranged to underlie the second surface thereby retaining the key within its respective polygonal opening upon insertion. Preferably a pair of flanges are used, and extend from nonadjacent sides of the off-set or keying portion of the key, while the locking tab is positioned between the nonadjacent sides and extends from the body section of the key.

It is an objective of the present invention to provide a system for retaining a key in its respective housing opening without using fastener components.

It is also an objective for the system to be activated upon mere insertion of the key into the opening.

It is a further objective for the system to be consistent with a reduced key member length resulting in a low profile arrangement.

DESCRIPTION OF THE FIGURES

FIG. 3 is a bottom view of the plug shown in FIG. 1, showing the mating face thereof;

DESCRIPTION OF THE PREFERRED EMBODIMENT

Figure 1:
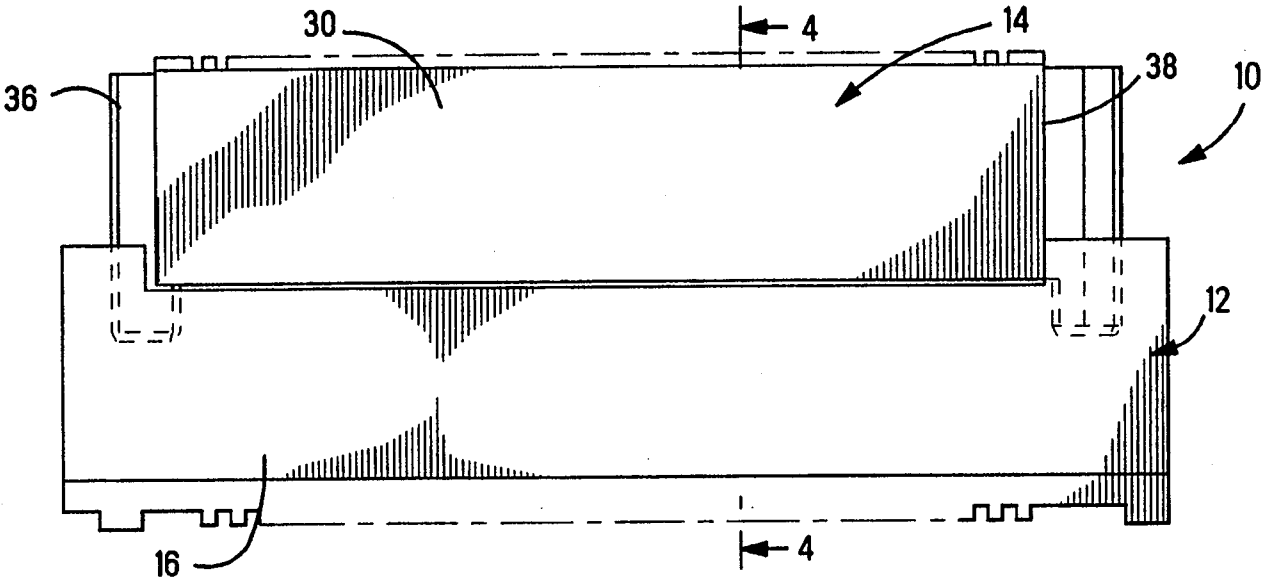
FIG. 1 is a front view of a mating connector assembly incorporating the teachings of the present invention and showing the plug partially engaging the receptacle.
Figure 2:
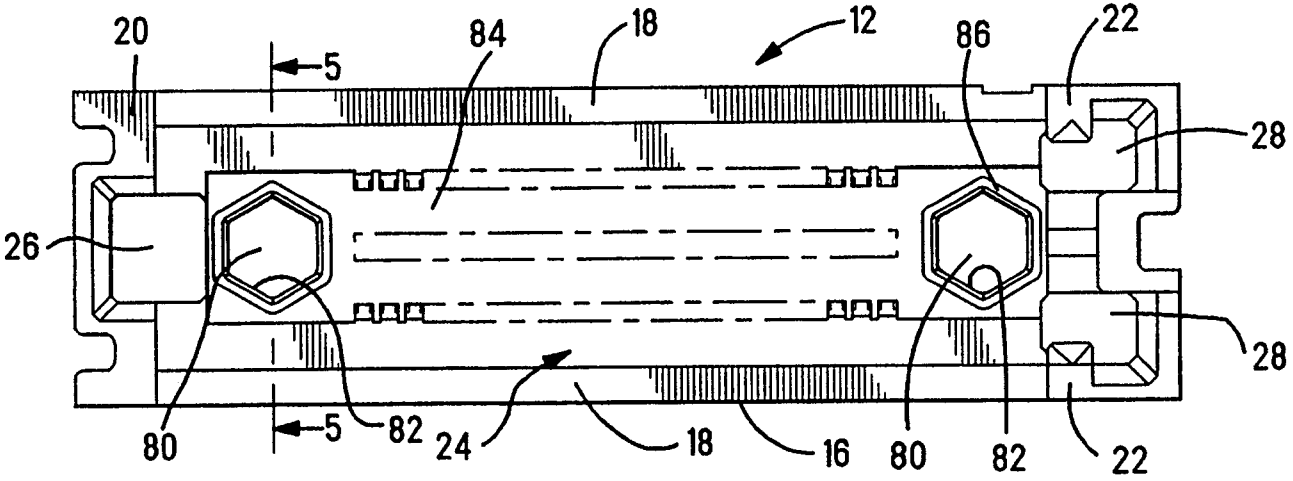
FIG. 2 is a top view of the receptacle shown in FIG. 1, showing the mating face thereof.

There is shown in FIG. 1 an electrical connector assembly 10 having a receptacle 12 and a mating plug 14. The receptacle 12 includes an insulating housing 16, as best seen in FIG. 2, having a pair of side walls 18, and two end walls 20 and 22 which form an interior cavity 24. Note that the contact cavities and other features of the interior of the receptacle housing are not shown. A rectangular opening 26 is formed in one end of the receptacle housing 16 and a pair of L-shaped openings 28 are formed in the other end. The plug 14 includes an insulating housing 30, as best seen in FIG. 3, having side walls 32 and end walls 34 which are spaced to closely fit within the interior cavity 24 of the receptacle housing 16 when the plug is mated with the receptacle. Note that the contact cavities and other interior features of the plug housing are not shown. The plug housing 30, as shown in FIG. 3, includes a rectangular projection 36 at one end and a pair of L-shaped projections 38 at the other end that are sized to closely fit within the openings 26 and 28, respectively, when the plug is mated to the receptacle. These projections and openings constitute a polarizing keying system that assures proper orientation of the plug and receptacle during mating.

Figure 4:
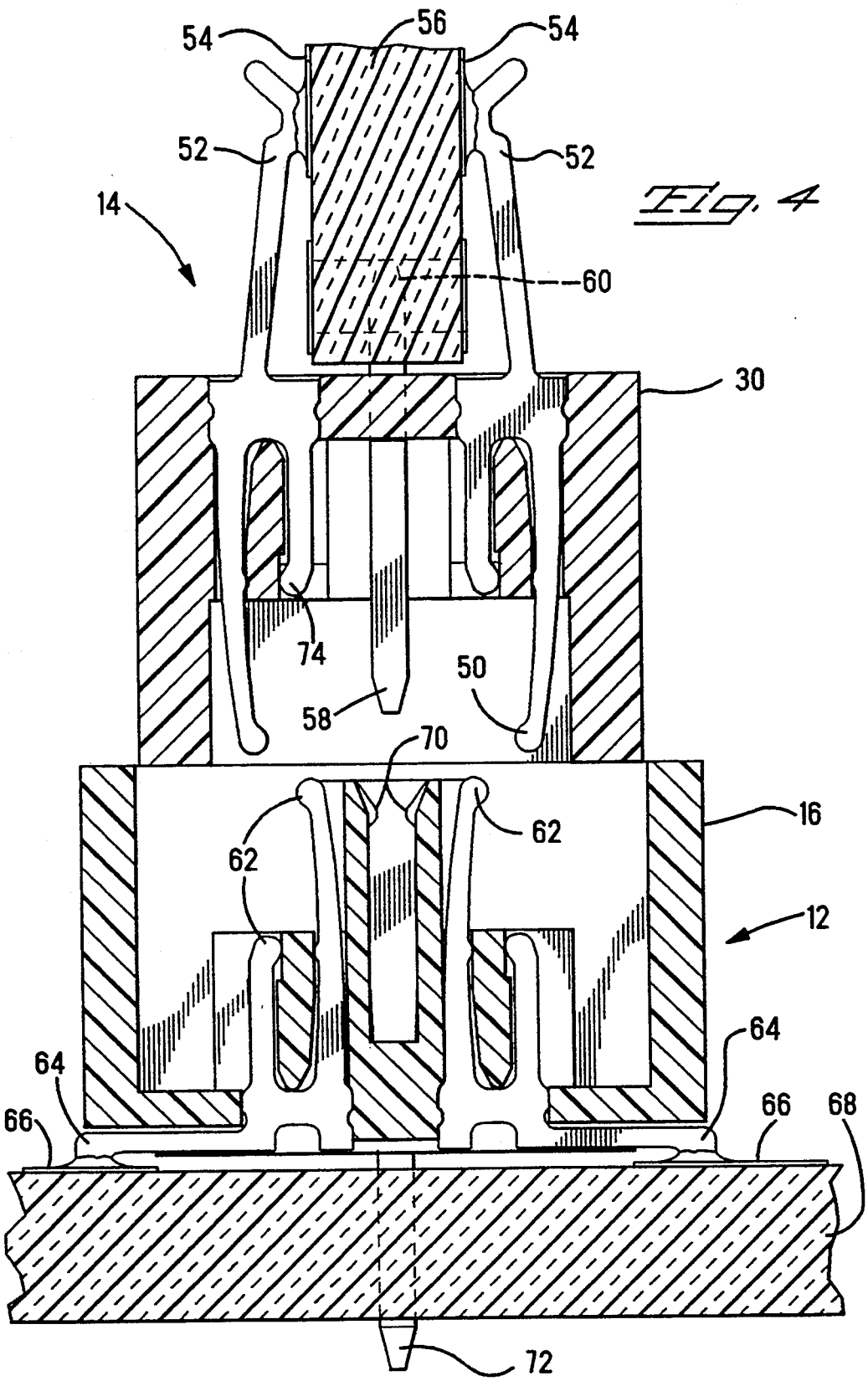
FIG. 4 is a cross-sectional view taken along the lines 4—4 of FIG. 1 showing the plug and receptacle prior to mating.
Figure 7:
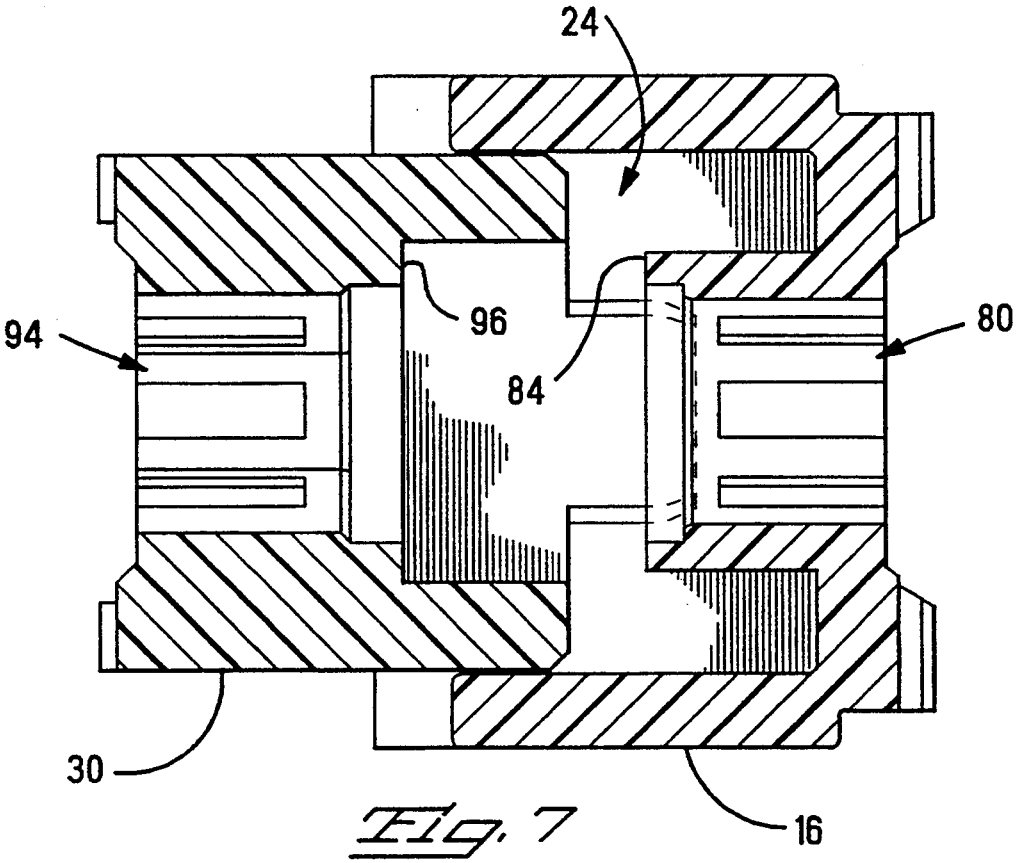

The receptacle 12 and plug 14 are shown in FIG. 4 in a typical application where the plug includes a series of electrical contacts 50 disposed in cavities in the plug housing 30. The contacts 50 have solder tails 52 that are soldered to circuit pads 54 on the major surfaces of a circuit board 56. A series of ground contacts 58 have tails 60 that project into openings in the edge of the circuit board and are electrically connected to ground circuitry on the circuit board, as disclosed in U.S. Pat. No. 5,199,885. Similarly, the receptacle 12 includes a series of contacts 62 having solder tails 64 that are soldered to pads 66 on another circuit board 68, and ground contacts 70 having tails 72 that extend into holes and engage ground circuitry on the circuit board 68. When the plug and receptacle are mated the contacts 50 mate with the contacts 62 and the ground contacts 58 mate with the ground contacts 70 in the usual manner.

Figure 6:
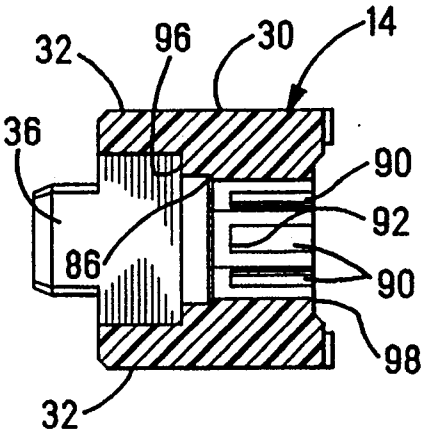
FIGS. 5 and 6 are cross-sectional views taken along the lines 5—5 and lines 6—6 of FIGS. 2 and 3 respectively.
Figure 5:
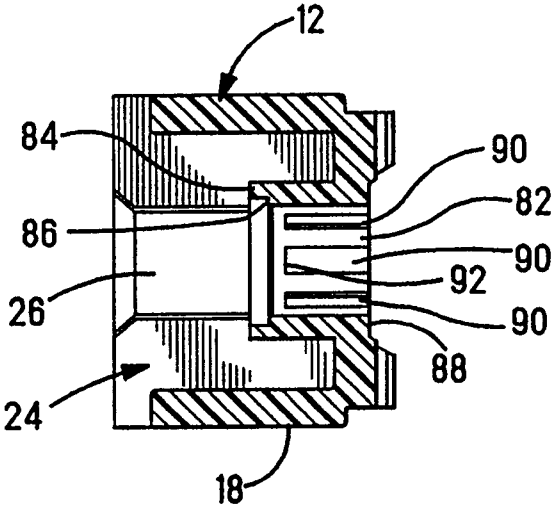

As shown in FIGS. 2 and 5, the receptacle housing 16 includes two key-receiving polygonal openings 80, one near each end, shown and described herein as hexagonal. Each hexagonal opening 80 has six equally spaced and identically dimensioned walls 82 extending completely through the floor 84 of the housing. Each wall 82 extends from a first surface 86 within the interior cavity 24 to a bottom surface 88 of the housing 16. A slot 90 is formed in each wall 82 extending from the bottom surface 88 of the housing 16 upwardly toward the first surface 86 and terminating in a shoulder 92 that is spaced from the first surface, as best seen in FIG. 5. The first surfaces 86 are substantially perpendicular with their respective walls 82 and are preferably arranged to form a single continuous surface encircling the hexagonal opening 80. As shown in FIGS. 3 and 6, the plug housing 30 has two hexagonal openings 94 extending completely through the housing which are identical in every respect to the hexagonal openings 80 in the receptacle housing 16, including walls 82, first surfaces 86, slots 90, and shoulders 92. The hexagonal openings 94 are spaced so that each will be in alignment with a respective opening 80 when the plug 14 is mated with the receptacle 12. The plug and receptacle housings, as shown in cross-sectional form in FIGS. 6 and 5 are shown partially mated in FIG. 7 and fully mated in FIG. 8, which are section views through key-receiving apertures 94,80 which are illustrated without key members therein. The plug housing 30 includes a mating face 96 which abuts the floor 84 of the receptacle housing 16 when the two housings are fully mated as shown in FIG. 8. The hexagonal openings 94 extend from the face 96 to the bottom 98 of the housing 30.

Figure 10:
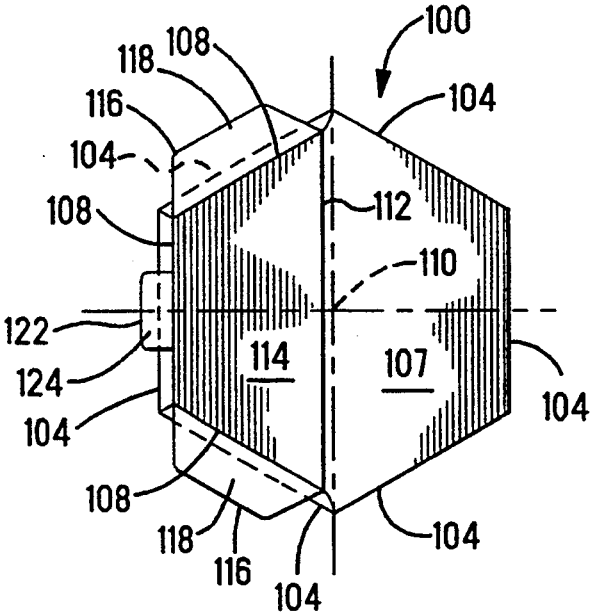
FIGS. 9 to 11 are front, top and side views of a key incorporating the teachings of the present invention.
Figure 11:
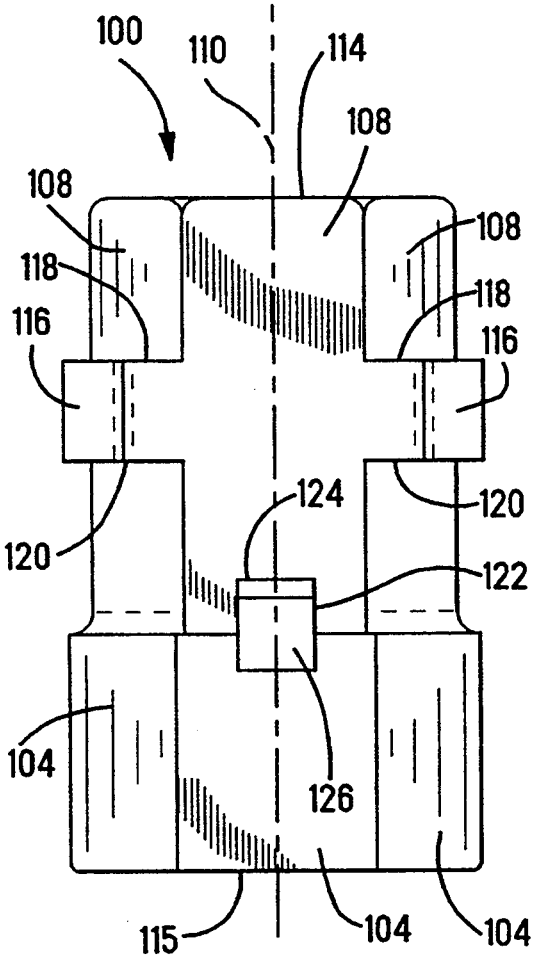
Figure 9:
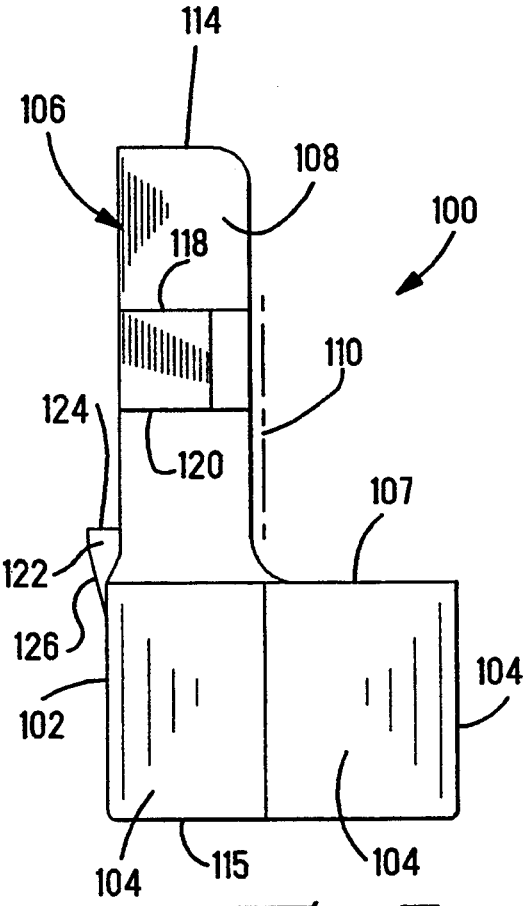

There is shown in FIGS. 9, 10, and 11 a key 100 including a shank 102 with a hexagonal shape having six side walls 104 that are sized so that the key is a slip fit with the hexagonal openings 80 and 94. A key element 106, or off-set portion, projects from a surface 107 of the shank 102 and has three side walls 108 each of which is parallel to a respective side wall 104 but spaced inwardly toward the axis 110 a slight amount to provide clearance within the openings 80 and 94, for a purpose that will be discussed. A fourth side wall 112 is arranged parallel with but spaced from the axes 110 so that the entire key element 106 is off-set and spaced from the axes 110, as shown in FIGS. 9 and 10. The walls 108 and 110 terminate at an end 114 while the walls 104 terminate at an opposite end 115. A pair of wing-like flanges 116 project outwardly from two of the side walls 108 about midway between the surface 107 and the end 114, as best seen in FIGS. 9 and 11. Each of the flanges 116 includes an upper surface 118 and a lower surface 120. A locking tab 122 projects outwardly from one of the side walls 104 of the shank 102 and has a surface 124 facing upwardly toward the end 114. An inclined surface 126 tapers from the side wall 104 outwardly and upwardly toward the surface 124, as viewed in FIG. 9.

Such keys can be machined of metal such as brass or stainless steel, or can be molded of plastic material similar to that used in the molded plastic housings of the connectors. The pair of flanges and the locking tab preferably are integral with the key, so that altogether no additional components such as screws or retention clips need be used, and retention occurs merely upon insertion of the key into the respective opening in the desired angular orientation, simplifying assembly. The pair of flanges can extend from the forward keying portion, while the locking tab can extend from the body section of the key, all so that the entire key length can be minimized.

Figure 7:
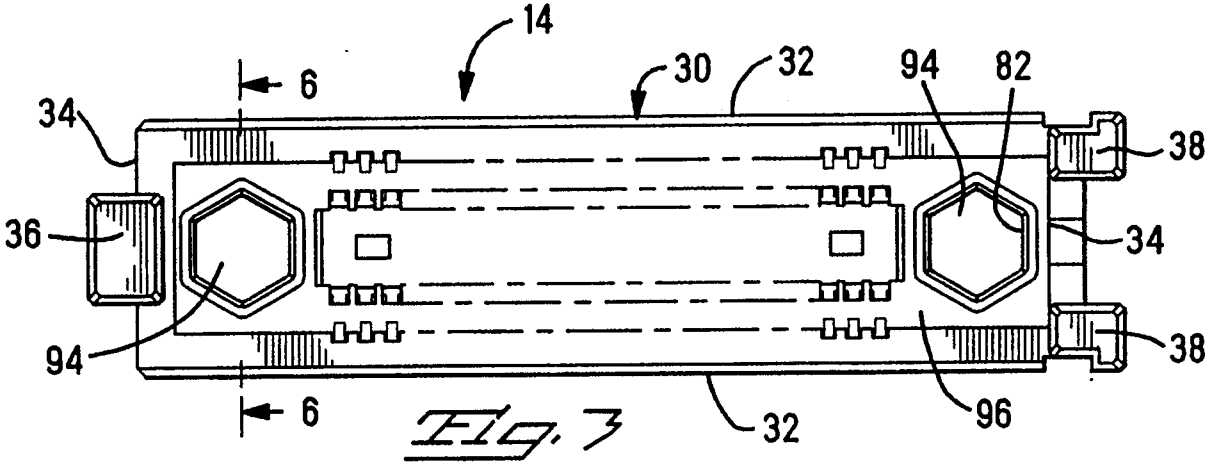
FIGS. 7 and 8 are cross-sectional views similar to those of FIGS. 5 and 6 showing the two housings partially mated and fully mated, respectively.
Figure 8:
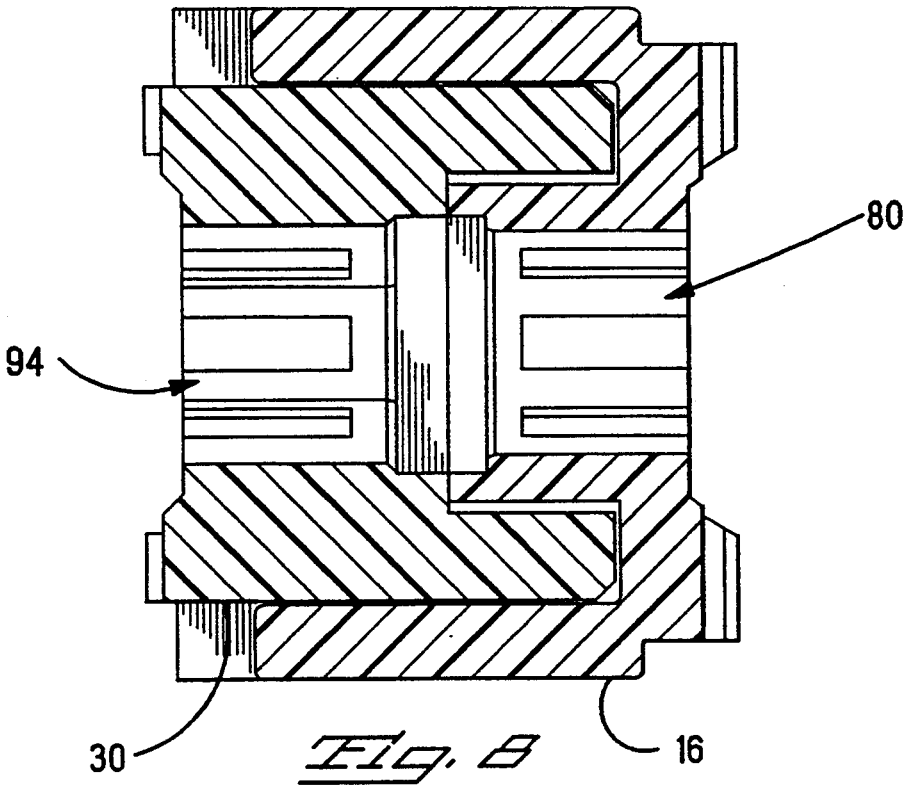
Figure 12:
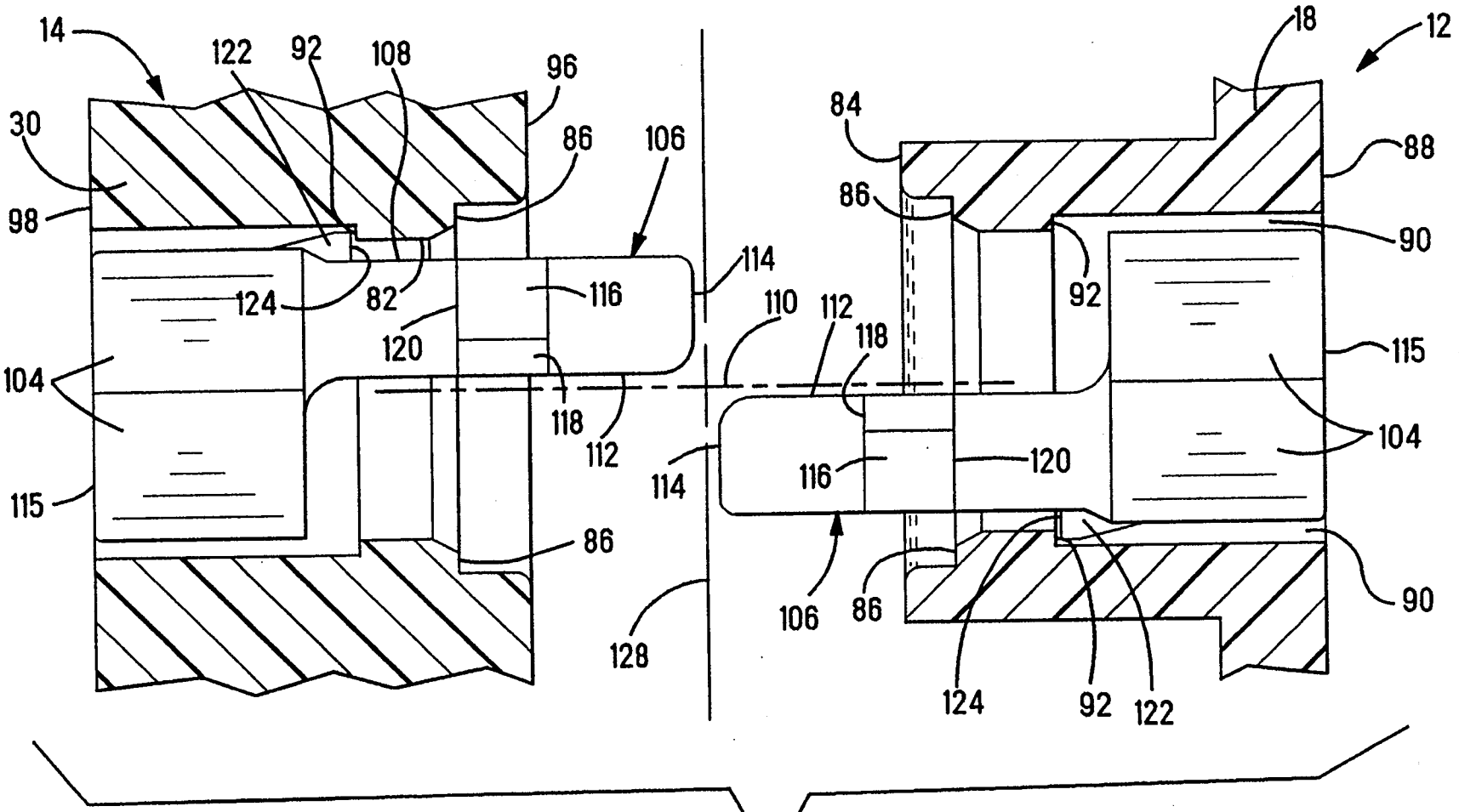
FIG. 12 is a cross-sectional view of a portion of that of FIG. 7 showing the keys in position.
Figure 14:
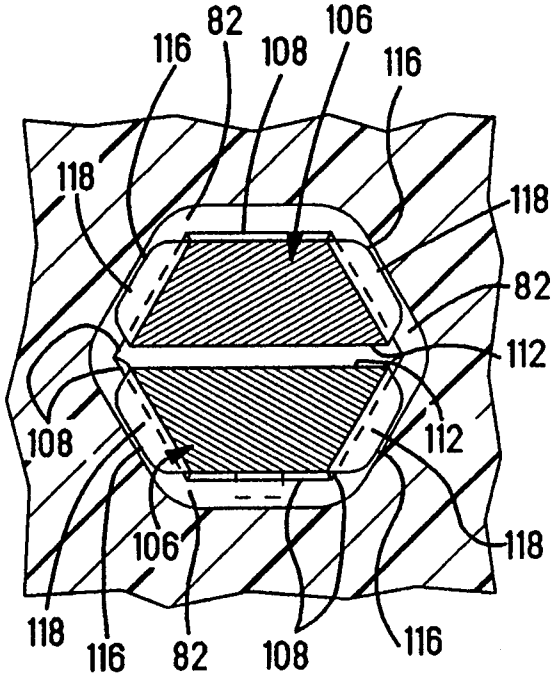
FIG. 14 is a cross-sectional view taken along the lines 14—14 of FIG. 13.
Figure 13:
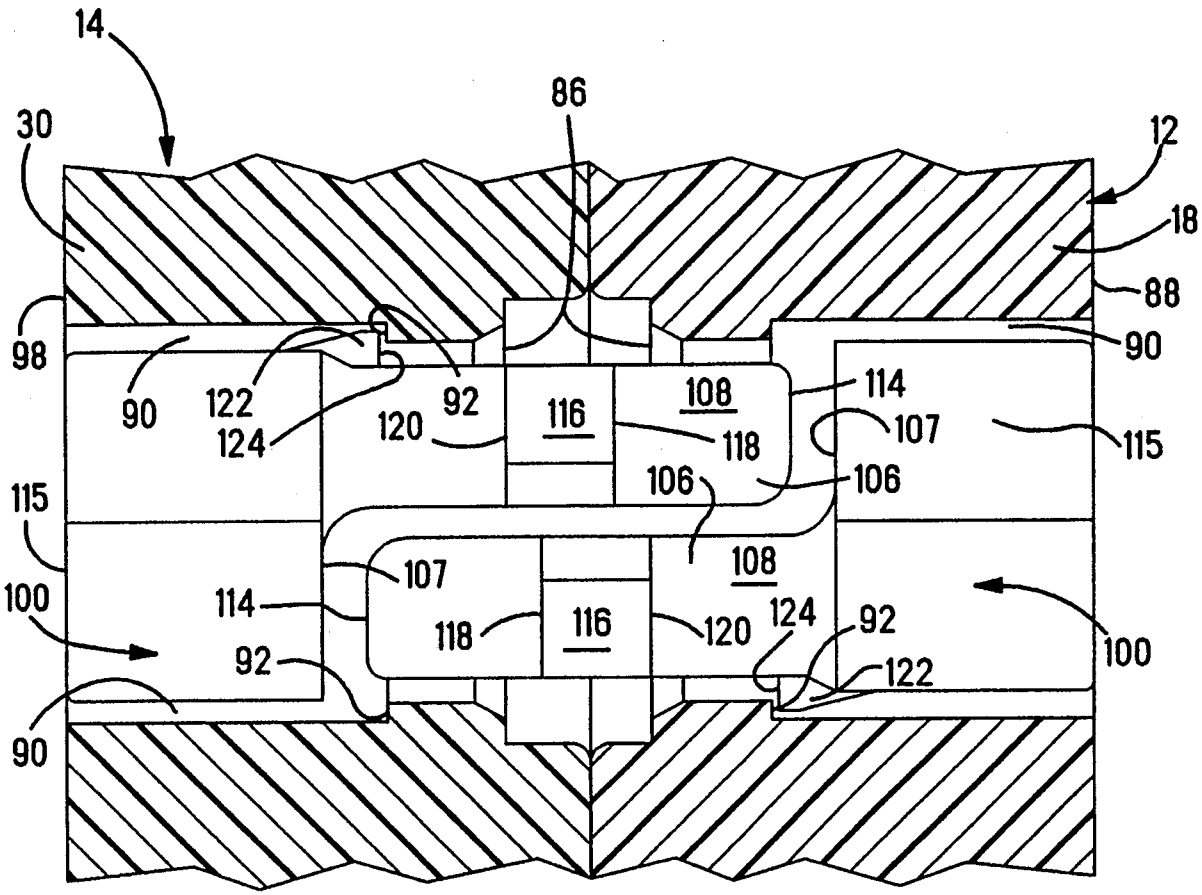
FIG. 13 is a view similar to that of FIG. 12 showing the two housings fully mated.

FIGS. 12 and 13 show enlarged portions of the views shown in FIGS. 7 and 8 respectively with two of the keys 100 in the two hexagonal openings 80 and 94. Note that the keys 100 are arranged within their respective hexagonal openings 80, 94 so that the surfaces 112 of the key elements will be opposing when the two housings are fully mated as shown in FIG. 13. The locking tab 122 is within one of the slots 90 with its surface 124 abutting the shoulder 92 of the housing and the surfaces 120 of the two flanges 116 adjacent the opposing first surfaces 86 with a slight amount of clearance therebetween. In this position, the surface 120 overlies the first surface 86 and the surface 124 underlies the surface of shoulder 92. The two surfaces 112 are spaced slightly apart for clearance and the side walls 108 of the key 100 in the opening 94 are also spaced from the walls 82 of the opening 80 as shown in FIG. 14. Similarly, the side walls 108 of the key in the opening 80 are spaced from the walls 82 of the opening 94. This permits the ends 114 of the two keys 100 to extend well into the opposing hexagonal opening without interference, as shown in FIG. 13. The first surfaces 86 are recessed into the floor 84 of the receptacle housing and the face 96 of the plug housing sufficiently so that when the two housings are mated, each first surface 86 does not engage the surfaces 118 of the opposing key.

It will be appreciated by those skilled in the art that while the hexagonal openings 80 and 94 in the present example have six walls 82, they may have fewer or more than six walls as long as the walls are arranged to form an approximate polygon so that a key 100 will slip fit into the opening in any of several unique angular positions, the number of positions normally being equal to the number of sides of the polygon. In such case the key 100 will have a corresponding polygonal shape, as viewed from FIG. 10. Additionally, the locking tab 122 may be of other shapes and may be associated with any of the side walls 104.

In operation, a pair of keys 100 are positioned into the two openings 80 of the receptacle housing 16. They are pressed into place by pushing on either of the surfaces 107 or 114 until the ends 115 engage a backing plate, not shown, that is temporarily positioned against the surface 88 of the housing. This brings the surfaces 120 of the flanges 116 into engagement with the first surfaces 86 of the housing. During this process, as the inclined surface 126 of the locking tab 122 engages and bears against the surface of the side wall 82, the tab and the side wall are caused to elastically deform slightly so that the tab can slide past and snap into the slot 90. Similarly, a pair of keys 100 are pressed into the openings 94 in the plug housing 30 so that when the plug is mated with the receptacle the key elements 106 that are axially aligned have their surfaces 112 mutually opposing. As the plug 14 is brought into position with respect to the receptacle 12, as shown in FIG. 1, the projections 36 and 38 enter the rectangular and L-shaped openings 26 and 28, thereby assuring that the plug is properly oriented with respect to the receptacle. As insertion of the plug continues, the two ends 114 of opposing pairs of key elements 106 reach a plane 128, as shown in FIG. 12. At this point the two housings are positioned as shown in FIG. 7 with the plug partially within the interior cavity 24 of the receptacle housing and the electrical contacts 50 and 62 not yet in engagement. Since the walls 18, 20, and 22 of the receptacle housing engage and align the outer walls 32 and 34 of the plug housing, there is no need for a long lead chamfer on the ends of the key elements 106 thereby permitting the overall length of the keys to be relatively short. If the two aligned keys do not have their key elements 106 in complimentary angular positions so that their surfaces 112 are opposed, the two ends 114 will mutually abut and prevent further entry of the plug into the receptacle. However, in the example illustrated in FIGS. 12 and 13, these surfaces are mutually opposed so that the two key elements 106 pass each other with a small amount of clearance and take the positions shown in FIG. 13 where the plug and receptacle are fully mated.

An important advantage of the present invention is that the keying arrangement will accommodate very low profile connectors without adding to their height. The keys for both the receptacle and the plug are identical so that only a single key need be stocked. The unique flanges 116 and locking tab 122 permit easy installation in the field immediately prior to mounting the connector on a circuit board thereby minimizing the required inventory of similar connectors with different keying arrangements.

I claim:

1. In an electrical connector having a plug and receptacle matable along a mating axis, each plug and receptacle including a housing having electrical contacts therein wherein each contact of said plug mates with a corresponding contact of said receptacle, and a first keying arrangement for polarizing to assure proper orientation of said plug with said receptacle during mating thereof, a second keying arrangement for inhibiting said mating except for mating a plug to a designated receptacle, comprising:

(a) a polygonal opening formed in said plug housing and a corresponding polygonal opening formed in said receptacle housing each defining a key-receiving axis therealong parallel to the mating axis so that when said housings are in mated engagement said polygonal opening in said plug housing is in axial alignment with said corresponding polygonal opening in said receptacle housing;

(b) two keys having body sections having polygonal shaped outer surfaces that are sized to slip fit into said polygonal openings in each of a plurality of unique angular positions, each said key being in a respective one of said polygonal openings of said plug and receptacle housings and having an offset half polygonal portion extending forwardly of the respective said body section to extend outwardly from said one of said polygonal openings into said corresponding aligned polygonal opening when said plug and receptacle housings are mated; and (c) retainer means for holding each said key in its respective polygonal opening, at least one said retainer means defines on both said key and said respective polygonal opening and including a first surface and an opposite second surface spaced axially from said first surface along each side wall of a respective said polygonal opening, and further including at least one flange projecting from a respective said key and arranged to overlie said first surface and a locking tab projecting from each key and arranged to underlie said second surface thereby retaining said key within its respective said polygonal opening upon insertion of said key into said polygonal opening, wherein each said key is arranged in one of said plurality of angular positions so that said plug and receptacle housings will mate only when said offset portions of the axially aligned keys are in mating alignment, and at least one of said keys is securable in its polygonal opening upon insertion thereinto and without other securing means.

2. The electrical connector according to claim 1 wherein each said at least one flange of each said at least one retainer means projects transversely from said offset portion just forwardly of said body section of said key, said locking tab extends transversely from said body portion spaced axially rearwardly from the rearward extent of said off-set portion, and said first surface is a forwardly facing surface of a respective one of said plug and receptacle housings, whereby the length of said body section may be minimized.

3. The electrical connector according to claim 2 wherein each said polygonal opening extends completely through its respective housing and each said key projects completely through its respective said polygonal opening.

4. The electrical connector according to claim 2 wherein said first and second surfaces are substantially perpendicular to their respective wall.

5. The electrical connector according to claim 1 wherein each said at least one retainer means includes a first surface and an opposite second surface spaced from said first surface along a side wall of a respective said polygonal opening, and further including at least one flange projecting from a respective said key and arranged to overlie said first surface and a locking tab projecting from each key and arranged to underlie said second surface thereby retaining said key within its respective said polygonal opening, whereby said keys for said plug and said receptacle are identical.

6. The electrical connector according to claim 1 wherein each said polygonal opening is hexagonal and each said key is of corresponding hexagonal shape.

7. The electrical connector according to claim 6 wherein said first surfaces of each hexagonal opening is defined by a continuous surface encircling said opening.

8. The electrical connector according to claim 7 including two flanges projecting from non-adjacent sides of said off-set portion of a respective said key arranged to overlie two said first surfaces of two non-adjacent walls.

9. The electrical connector according to claim 8 wherein said locking tab is arranged to underlie a second surface of a wall that is between said two non-adjacent walls.

10. The electrical connector according to claim 9 wherein said wall between said two non-adjacent walls is adjacent to both non-adjacent walls.

11. The electrical connector according to claim 6 wherein said second surfaces of each hexagonal opening are defined by a continuous surface extending circumferentially around said opening.

12. In an electrical connector having a mating plug and receptacle, each plug and receptacle including a housing having electrical contacts therein wherein each contact of said plug mates with a corresponding contact of said receptacle, and a first keying arrangement for polarizing to assure proper orientation of said plug with said receptacle during mating thereof, a second keying arrangement for inhibiting said mating except for mating a plug to a designated receptacle, comprising:

(a) a pair of spaced polygonal openings formed in said plug housing and a corresponding pair of polygonal openings formed in said receptacle housing so that when said housings are in mated engagement each said polygonal opening in said plug housing is in axial alignment with a corresponding one of said polygonal openings in said receptacle housing;

(b) four keys having body sections having polygonal shaped outer surfaces that are sized to slip fit into said polygonal openings in each of a plurality of unique angular positions, each said key being in a respective one of said polygonal openings of said plug and receptacle housings and having an offset half polygonal portion extending forwardly of the respective said body section to extend outwardly from said one of said polygonal openings into said corresponding aligned polygonal opening when said plug and receptacle housings are mated; and (c) retainer means for holding each said key in its respective polygonal opening, each said retainer means defines on both said key and said respective polygonal opening and including a first surface and an opposite second surface spaced axially from said first surface along each side wall of a respective said polygonal opening, and further including at least one flange projecting from a respective said key and arranged to overlie said first surface and a locking tab projecting from each key and arranged to underlie said second surface thereby retaining said key within its respective said polygonal opening upon insertion of said key into a respective said polygonal opening, wherein each said key is arranged in one of said plurality of angular positions so that said plug and receptacle housings will mate only when said off-set portions of the axially aligned keys are in mating alignment, each said key is securable in its polygonal opening upon insertion thereinto and without other securing means, and said four keys are identical.

13. The electrical connector according to claim 12 wherein each one of said pair of spaced polygonal openings is located adjacent a respective end of a respective of one of said housings.

14. The electrical connector according to claim 12 wherein each said at least one flange of each said retainer means projects transversely from said off-set portion just forwardly of said body section of said key, said locking tab extends transversely from said body portion spaced axially rearwardly from the rearward extent of said off-set portion, and said first surface is a forwardly facing surface of a respective one of said plug and receptacle housings, whereby the length of said body section may be minimized.

15. The electrical connector according to claim 12 wherein each said polygonal opening extends completely through its respective housing and each said key projects completely through its respective said polygonal opening.

16. The electrical connector according to claim 12 including two flanges projecting from non-adjacent sides of said off-set portion of each said key arranged to overlie two said first surfaces of two non-adjacent walls.

17. The electrical connector according to claim 16 wherein said locking tab is arranged to underlie a second surface of a wall that is between said two non-adjacent walls.

18. The electrical connector according to claim 12 wherein said first and second surfaces of each polygonal opening are defined by respective continuous surfaces extending circumferentially around said opening.

* * * * *